US008521066B2

(12) United States Patent
Nose

(10) Patent No.: US 8,521,066 B2
(45) Date of Patent: Aug. 27, 2013

(54) AUTOMATIC DOCUMENT TRANSPORTATION DEVICE AND DOCUMENT SCANNING DEVICE EQUIPPED WITH THE SAME

(75) Inventor: Yoshitaka Nose, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 422 days.

(21) Appl. No.: 12/964,795

(22) Filed: Dec. 10, 2010

(65) Prior Publication Data

US 2011/0146435 A1 Jun. 23, 2011

(30) Foreign Application Priority Data

Dec. 17, 2009 (JP) ..... 2009-286369

(51) Int. Cl.
*G03G 21/00* (2006.01)

(52) U.S. Cl.
USPC ..... 399/124; 399/125

(58) Field of Classification Search
CPC ..... G03G 21/1623; G03G 2221/1687; G03G 2215/00544; G03G 21/16; G03G 21/1628; G03G 21/1633; G03G 21/1638; G03G 2221/169
USPC ..... 399/124, 125
See application file for complete search history.

(56) References Cited

U.S. PATENT DOCUMENTS

| | | | | |
|---|---|---|---|---|
| 7,349,650 | B2 * | 3/2008 | Sunohara | 399/124 |
| 7,418,766 | B2 * | 9/2008 | Nelson et al. | 16/239 |
| 7,702,255 | B2 * | 4/2010 | Ishii | 399/124 |
| 7,878,666 | B2 * | 2/2011 | Muraki et al. | 353/122 |
| 2006/0130277 | A1 * | 6/2006 | Nelson et al. | 16/327 |
| 2009/0232545 | A1 * | 9/2009 | Tonges et al. | 399/119 |
| 2010/0315658 | A1 * | 12/2010 | Niikawa | 358/1.5 |
| 2011/0243608 | A1 * | 10/2011 | Nishimura et al. | 399/125 |
| 2011/0299139 | A1 * | 12/2011 | Ikebata | 358/474 |

FOREIGN PATENT DOCUMENTS

JP 2001-088854 A 4/2001

* cited by examiner

*Primary Examiner* — Kaitlin Joerger
(74) *Attorney, Agent, or Firm* — Keating & Bennett, LLP

(57) ABSTRACT

An ADF includes an ADF main body portion, a scanner frame, a gear portion, a resistance gear, a torque limiter, and an outer cover. The scanner frame is arranged to be supported at the ADF main body portion such that it is rotatable. The gear portion is arranged on a rotation axis line of the scanner frame to integrally rotate with the scanner frame. The torque limiter is arranged to apply a resistance to the resistance gear that meshes with the gear portion when the scanner frame rotates from an exposed position to a usage position. The outer cover is attached to the ADF main body portion to cover one portion of the gear portion. The outer cover includes a contacting portion arranged to regulate the movement of the gear portion.

7 Claims, 8 Drawing Sheets

AUTOMATIC DOCUMENT TRANSPORTATION DEVICE AND DOCUMENT SCANNING DEVICE EQUIPPED WITH THE SAME

CROSS-REFERENCE TO RELATED APPLICATIONS

This application claims priority under 35 U.S.C. 119 to Japanese Patent Application No. 2009-286369, filed on Dec. 17, 2009, which application is hereby incorporated by reference in its entirety.

BACKGROUND OF THE INVENTION

1. Field of the Invention

The present invention relates to a rotation mechanism arranged to expose an interior of an automatic document transportation device.

2. Description of the Related Art

Conventionally, an automatic document transportation device having a configuration of including a rotation mechanism arranged to expose an interior is known and an image processing device equipped with this type of automatic document transportation device is also known in the prior art.

The prior art discloses an image processing device configured as below. The conventional image processing device includes a cover unit arranged in a freely rotating manner about a supporting shaft between an operation position of covering an upper surface of a device main body incorporating an image processing unit and a standby position of opening the upper surface. The conventional image processing device also includes a biasing unit for generating a biasing force for rotating the cover unit toward the standby position side to prevent the cover unit from dropping from the standby position toward the operation position due to weight of the cover. The conventional image processing device further includes a stopping unit for causing the cover unit to be in an immovable state at the operation position. The biasing unit and the stopping unit are arranged at a common base fixed to the device main body.

The configuration disclosed in the prior art alleviates an impact when the cover unit drops, since an arc-shaped gear meshes with a torque gear when the cover unit rotates. Such a configuration exhibits a resistance force while the arc-shaped gear meshes with the torque gear, but the resistance is no longer applied at the time that the meshing of the arc-shaped gear and the torque gear is released. Thus, the arc-shaped gear needs to be made as long as possible. If the arc-shaped gear is long, however, the possibility of the arc-shaped gear interfering with another member when the cover unit rotates becomes higher.

The following configuration has been considered for improving the above described problems. This configuration includes a wheel shaped gear portion that integrally rotates with a frame and is arranged on the same axis line as the center of rotation of the frame rotatably supported to open one part of a document transportation path. A resistance unit for applying resistance to the gear portion is arranged to mesh with the gear portion. According to such a configuration, an automatic document transportation device capable of continuously applying the resistance over the entire range of the rotation stroke of the frame can be realized with a simple configuration. This configuration, however, has a drawback in that the gear portion is subjected to a force in the direction of releasing the meshing with the resistance unit by the resistance of the resistance unit at the time of the rotation of the frame and the gear portion rides over the resistance unit (floating of the gear portion). Thus, if such a configuration is adopted, a dedicated member for preventing the floating of the gear portion must be added. However, the addition of a dedicated member leads to an increase in the manufacturing cost and an increase in the number of components. Therefore, improvement can still be made from the standpoint of enhancing the productivity in the configuration of arranging the gear portion that integrally rotates with the frame on the same axis line as the center of rotation of the frame.

SUMMARY OF THE INVENTION

Preferred embodiments of the present invention have been made in view of the circumstances described above, and provide an automatic document transportation device capable of realizing, with a simple configuration, a mechanism that effectively alleviates an impact in a case where a frame drops.

These preferred embodiments solve the problem of the conventional art discussed above. The arrangements of the preferred embodiments of the present invention and how these arrangements act to solve the problems of the conventional art will now be described below.

According to a first preferred embodiment of the present invention, an automatic document transportation device configured as below is provided. The automatic document transportation device preferably includes a main body portion, a rotation frame, a gear portion, a resistance gear, a brake portion, and an outer cover. The rotation frame is arranged to be supported at the main body portion to be rotatable from a usage position to an exposed position on an upper side to open one portion of a document transportation path. The gear portion preferably has a wheel shape and is arranged on a rotation axis line of the rotation frame to integrally rotate with the rotation frame. The resistance gear is arranged to mesh with the gear portion. The brake portion applies resistance to the resistance gear when the rotation frame rotates from the exposed position to the usage position on the lower side. The outer cover is preferably attached to the main body portion so as to cover at least one portion of the gear portion. The outer cover preferably includes a contacting portion arranged to provide movement of the gear portion in the direction of moving away from the resistance gear.

Thus, when the gear portion attempts to move in a moving direction away from the resistance gear due to a reactive force of the resistance gear applied with resistance by the brake portion at the time of the rotation of the rotation frame, such movement can be regulated by the outer cover. Thus, the meshing of the gear portion and the resistance gear at the time of the rotation of the rotation frame can be maintained in a satisfactory state. Therefore, the resistance provided by the brake portion can be efficiently transmitted to the rotation frame through the resistance gear and the gear portion, and thus the impact caused when the rotation frame drops can be effectively alleviated. Accordingly, as the outer cover positions the gear portion, the component arranged to regulate the movement, such as, for example, floating of the gear portion, can be omitted from the configuration of the automatic document transportation device, to thereby achieve a reduction in the number of components and enhancement in the efficiency of the assembly task.

In the above-described automatic document transportation device, the contacting portion of the outer cover is preferably defined by an arc-shape according to the shape of the gear portion.

By using the above-described arrangement, a large contacting area in which the contacting portion comes in contact with the gear portion can be ensured in the circumferential direction of the gear portion, and the positioning of the gear portion can be stably and reliably carried out. Furthermore, the movement of the gear portion can be regulated in a wide range by the contacting portion having an arc-shape.

In the above-described automatic document transportation device, the contacting portion of the outer cover is preferably elongated in a rotating direction of the gear portion.

The resistance to the gear portion by the contacting portion generated at the time of the rotation of the rotation frame thus can be reduced. Therefore, the movement of the gear portion can be regulated by the outer cover while smoothly rotating the rotation frame.

The automatic document transportation device is preferably configured as below. The contacting portion of the outer cover is configured to come in contact with the gear portion at a position different in the axial direction of the gear portion from a portion where the gear portion meshes with the resistance gear.

The contacting portion thus comes in contact with the gear portion at a portion of the gear portion that is not meshed with the resistance gear. Therefore, even if the teeth of the gear portion wear due to contact with the contacting portion, the meshing between the gear portion and the resistance gear will be maintained in an appropriate state as the worn portion is the portion that does not mesh with the resistance gear. The rotation frame thus can be smoothly rotated without being influenced by an amount of wear of the gear portion.

In the automatic document transportation device, the gear portion is preferably integrally defined with the rotation frame.

The component arranged to attach the gear portion to the rotation frame thus can be omitted, and the number of components can be further reduced.

In the above-described automatic document transportation device, the gear portion is preferably arranged on an outer side in a document width direction of the document transportation path.

A situation where the gear portion obstructs the transportation of the document thus can be reliably prevented. Also, jammed documents can be effectively prevented from being caught at the gear portion in a maintenance task.

In the above-described automatic document transportation device, the rotation frame preferably includes a transportation roller arranged so that the axis line coincides with the center of rotation of the gear portion.

Since the position of the transportation roller does not change at the time of the rotation of the rotation frame, a situation where the transportation roller comes in contact with another member and breaks due to the rotation of the rotation frame can be reliably prevented. Furthermore, since the gear portion is fixed by the outer cover, the transportation roller is positioned along with the gear portion. Therefore, the component arranged to position the transportation roller can be omitted, and the number of components can be further reduced.

According to a second preferred embodiment of the present invention, a document scanning device including the automatic document transportation device is provided.

The above and other elements, features, steps, characteristics and advantages of the present invention will become more apparent from the following detailed description of the preferred embodiments with reference to the attached drawings.

DETAILED DESCRIPTION OF PREFERRED EMBODIMENTS

Figure 1:
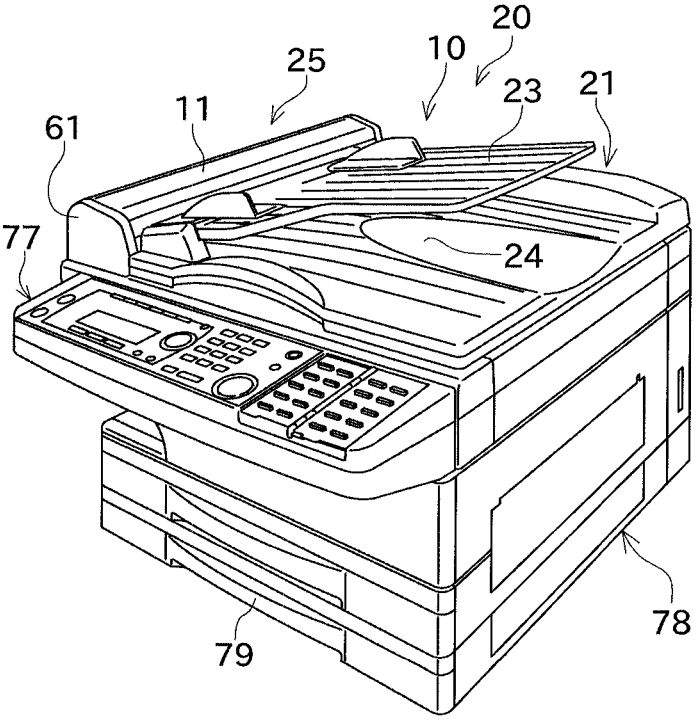
FIG. 1 is a perspective view of an outer appearance illustrating a state of a copy facsimile multifunction peripheral including an ADF and an image scanner device according to a preferred embodiment of the present invention.
Figure 2:
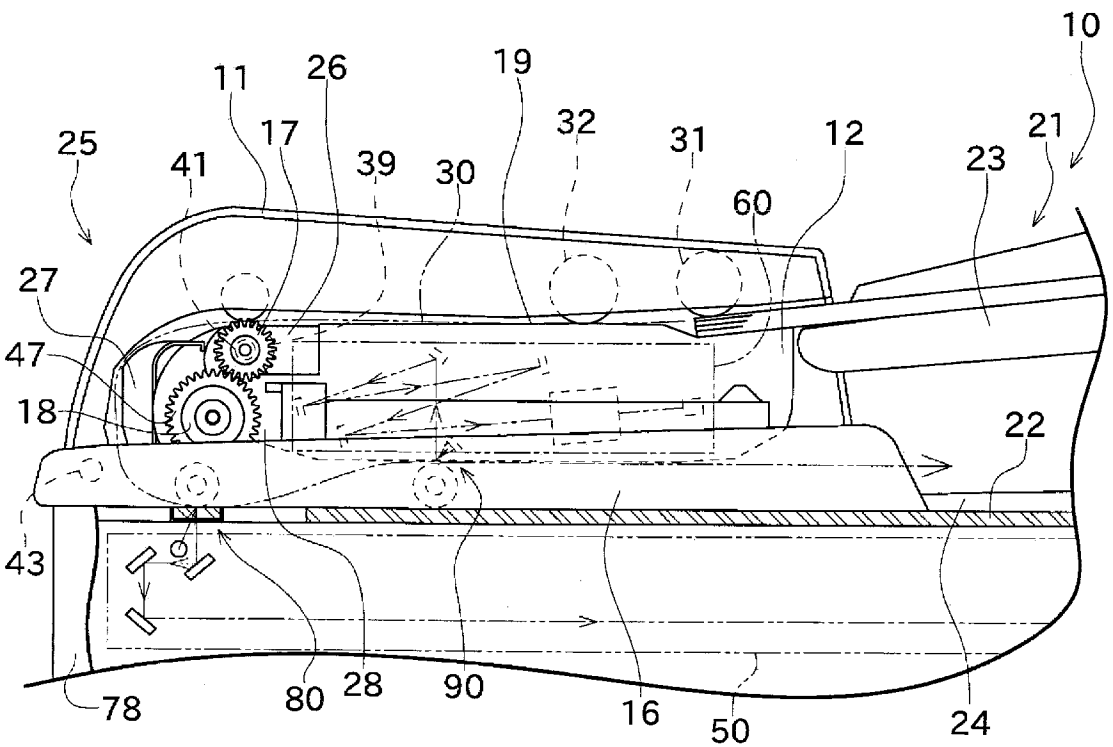
FIG. 2 is a front cross-sectional view illustrating a configuration of the ADF and the image scanner device of a preferred embodiment of the present invention.

Preferred embodiments of the present invention will now be described below in detail. FIG. 1 is a perspective view of an outer appearance of a copy facsimile multifunction peripheral 20 including an image scanner device 10 serving as a document scanning device according to one preferred embodiment of the present invention. FIG. 2 is a front cross-sectional view illustrating a configuration of the image scanner device 10 including an automatic document transportation device (Auto Document Feeder, ADF) 25.

The copy facsimile multifunction peripheral 20 illustrated in FIG. 1 includes the image scanner device 10 functioning as a book scanner and an auto document feed scanner at an upper portion of the multifunction peripheral 20. The multifunction peripheral 20 also preferably includes an operation panel 77 arranged to be used in instructing the number of copies, the facsimile transmitting destination, the document scanning, and the like.

The multifunction peripheral 20 also includes a main body 78, which preferably incorporates an image forming unit arranged to form images on a paper serving as a record medium, and the like, and a paper feed cassette 79 arranged to sequentially supply the paper. The main body 78 also preferably includes a transmission and reception unit (not illustrated) arranged to transmit image data through a communication line, and the like.

The image scanner device 10 arranged in the multifunction peripheral 20 will now be described with reference to FIG. 2. As illustrated in FIG. 2, the image scanner device 10 includes a platen glass 22 and a platen cover 21. The ADF 25 is arranged on an upper surface of the platen cover 21. The image scanner device 10 preferably includes a main body side scanner unit 50 arranged on the main body 78 side and an ADF side scanner unit 60 arranged on the ADF 25 side as scanning units arranged to scan the image of the document.

The ADF 25 preferably includes a document tray 23, a discharge tray 24, an ADF main body portion 16, an open/close cover 11, and an outer cover 61 (not illustrated in FIG. 2).

The document tray 23 is preferably arranged at the upper portion of the platen cover 21. The discharge tray 24 is preferably arranged at the lower side of the document tray 23. The open/close cover 11 is arranged to cover the upper side of the ADF main body portion 16 and is rotatably supported at the ADF main body portion 16 through a cover rotation shaft 43. The outer cover 61 is removably attached to the ADF main body portion 16 at the front surface side of the ADF 25 (see FIG. 1).

As illustrated in FIG. 2, a curved (laterally facing U-shape in front view) document transportation path 30 arranged to connect the document tray 23 and the discharge tray 24 is defined inside the platen cover 21. With such a configuration, documents that are piled and set on the document tray 23 can be separated one by one and transported along the document transportation path 30 and discharged to the discharge tray 24. The instruction to start scanning the document and the like can be made by, for example, the operation panel 77 illustrated in FIG. 1.

The configuration of each section of the ADF 25 will now be described in detail along the document transportation path 30.

As illustrated in FIG. 2, a pickup roller 31 is arranged in an area where the document is supplied from the document tray 23 to the document transportation path 30. A separation roller 32 is arranged on the downstream side of the pickup roller 31. The document at the upper most layer of the document tray 23 is fed into the ADF 25 when the pickup roller 31 is driven. The document is sent to the separation roller 32 by the drive of the pickup roller 31. The document is then separated one by one by the separation roller 32, which rotatably drives, and a separation pad (not illustrated), and then transported to the downstream side of the document transportation path 30.

A resist roller 39 and an opposing roller, which defines a pair with the resist roller 39, are arranged on the downstream side of the separation roller 32. The resist roller 39 temporarily stops and loosens the leading side of the document being transported by the separation roller 32 along with the opposing roller, and transports the same to the downstream side while removing the loosening after a predetermined period of time. Any possible oblique alignment of the document is thereby corrected. A plurality of transportation rollers (not illustrated) are arranged on the downstream side of the resist roller 39, where the document transported to the downstream side by the drive of the resist roller 39 is nipped by the plurality of transportation rollers and the rollers opposing thereto, and then further transported to the downstream side.

As illustrated in FIG. 2, a first document scan position 80 is arranged on the document transportation path 30 on the downstream side than the resist roller 39, and a second document scan position 90 is arranged on the further downstream side of the first document scan position 80. The first document scan position 80 is the position where a first surface of the document is scanned by the main body side scanner unit 50. The second document scan position 90 is the position where a second surface of the document is scanned by the ADF side scanner unit 60.

The main body side scanner unit 50 is arranged at an upper portion in the main body 78, and is configured as a scanning unit of a reduction optical system including a light source, a reflecting mirror, a light-gathering lens, a Charge Coupled Device (CCD) and the like. The light source, the reflecting mirror, and the like of the scanner unit are configured to be appropriately movable, and can scan and read the document on the platen glass 22 arranged at the upper surface of the main body 78. The platen cover 21 is arranged on the upper side of the main body 78, where the document is pushed and fixed on the platen glass 22 with the platen cover 21 when scanning the document on the platen glass 22. The components of the main body side scanner unit 50 are moved in such a state to scan the relevant document.

The ADF side scanner unit 60 is configured as a scanning unit of a reduction optical system including a light source, a reflecting mirror, a light-gathering lens, a Charge Coupled Device (CCD) and the like, similar to the main body side scanner unit 50. The ADF side scanner unit 60 is held by a scanner frame 12 on the inner side of the document transportation path 30 so as to come in contact with the document transportation path 30 configured to a U-shape from the inner side.

The scanner frame 12 is configured to seal and support the components configuring the optical system of the ADF side scanner unit 60, and the like on the inside, and to cover and protect the outer side thereof. A scanning glass (not illustrated) serving as a document scanning portion is arranged at the lower surface of the scanner frame 12. The scanner frame 12 includes a guide surface 19 arranged to guide the document from the inner side of the document transportation path 30 defined on the upper surface, and functioning as one portion of the document transportation path 30. The scanner frame 12 of the present preferred embodiment is rotatably supported at the ADF main body portion 16 to open one portion of the document transportation path 30 in the vicinity of the scanning glass. The details of the rotation mechanism arranged to rotate the scanner frame 12 will be described later.

A main body side guide portion 27 arranged to guide the document guided by the guide surface 19 to the first document scan position 80 is arranged on the downstream side of the guide surface 19. The main body side guide portion 27 is fixed to the ADF main body portion 16 at a position independent from the scanner frame 12, and includes a main body side guide surface arranged to guide the document from the inner side of the turn-back portion of the document transportation path 30.

When using the image scanner device 10 as the auto document feed scanner, as illustrated in FIG. 2, the light source, the reflecting mirror, and the like are moved up to the positions facing the first document scan position 80 of the document transportation path 30 and made stationary. In this state, the document is transported one by one by the ADF 25. The image on a surface (a first surface) on the front side of the document is scanned by the main body side scanner unit 50 at the first document scan position 80, and an image on a surface (a second surface) on the back side is scanned by the ADF side scanner unit 60 at the second document scan position 90. The document which content on both front and back surfaces are scanned at the two document scan positions is then discharged to the discharge tray 24. Thus, a so-called one-path ADF 25 having a configuration capable of scanning both surfaces by simply passing the document through the document transportation path 30 once is provided.

A signal including the image information scanned by the main body side scanner unit 50 and the ADF side scanner unit 60 is appropriately subjected to a conversion process, and transmitted to the image forming unit arranged in the multifunction peripheral 20. The transmitted image information is transferred to paper serving as a record medium by the image forming unit, thereby realizing the copy function, etc. of the multifunction peripheral 20.

Figure 3:
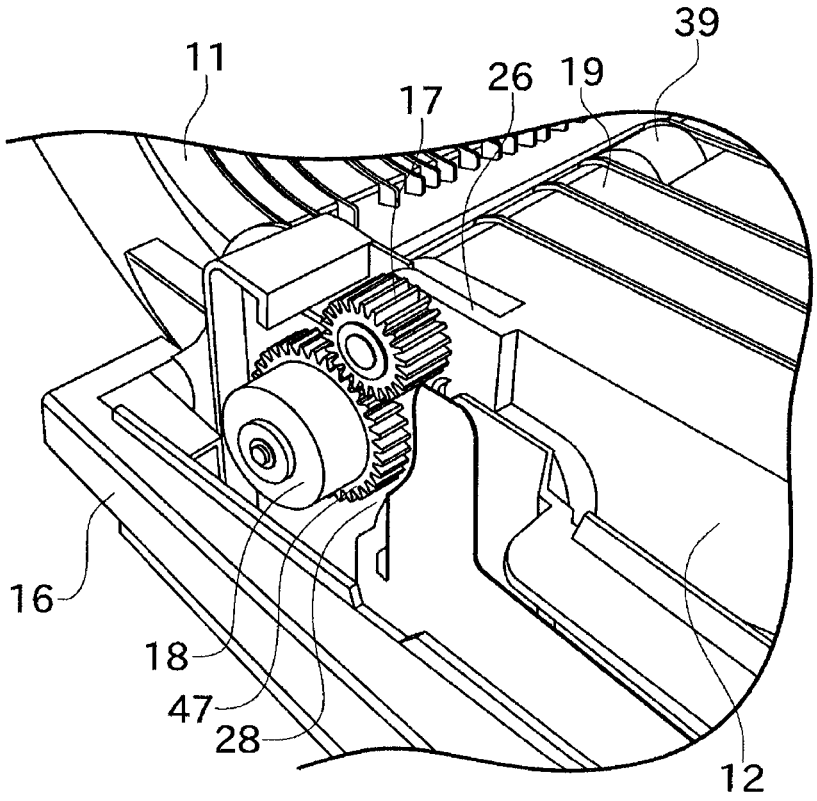
FIG. 3 is a perspective view illustrating a state of a front surface side of the ADF with an outer cover detached.
Figure 4:
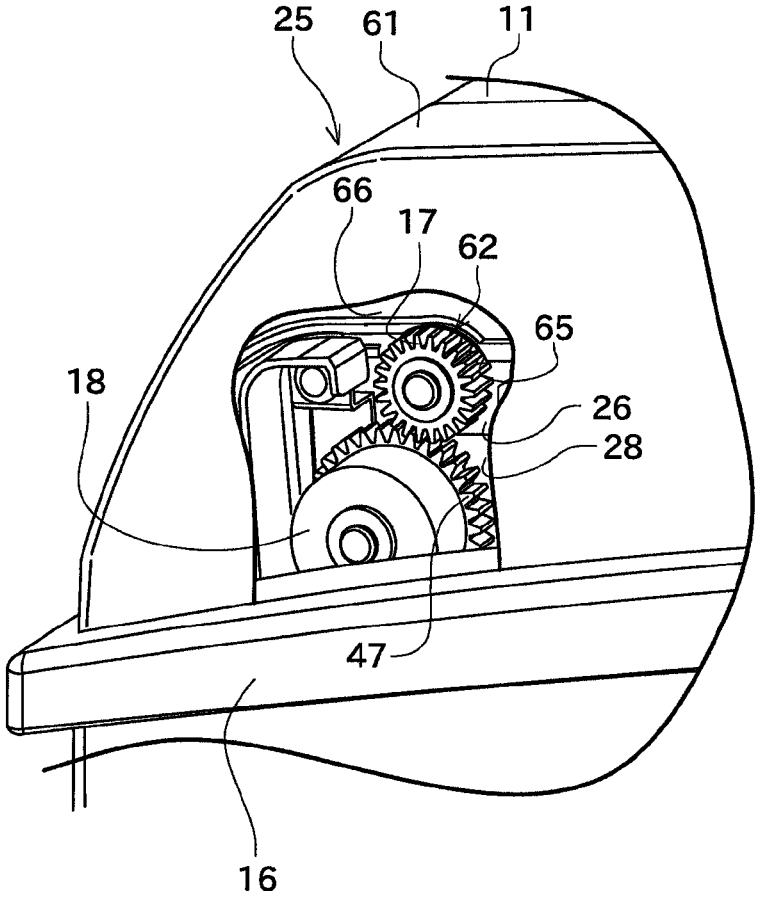
FIG. 4 is a perspective view illustrating a relationship between the outer cover and a gear portion seen from the front surface side of the ADF.
Figure 5:
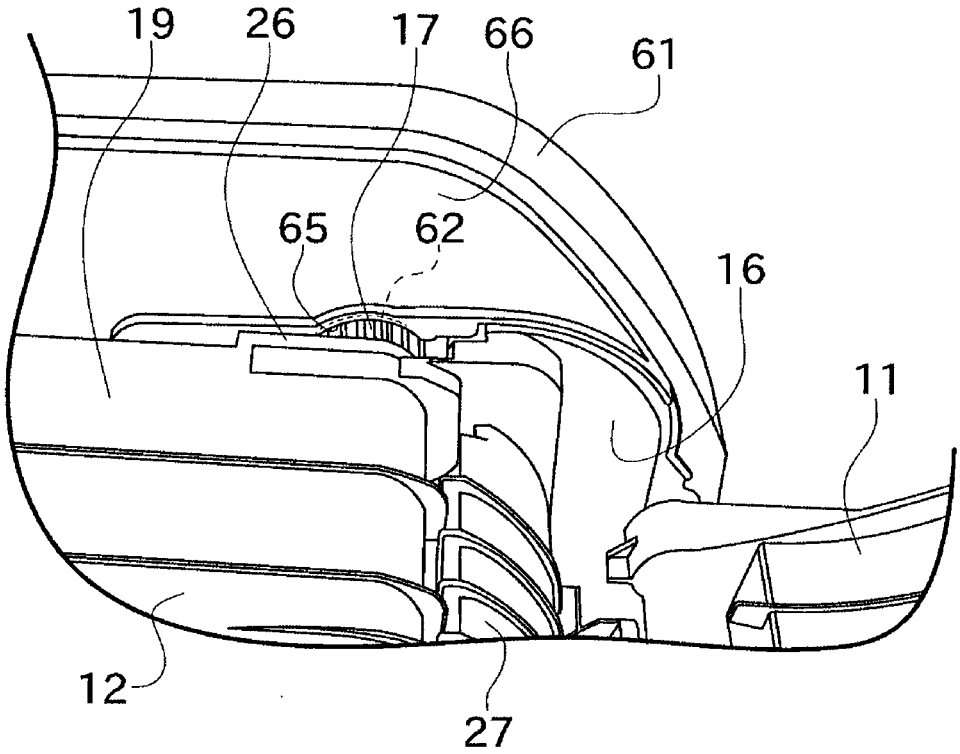
FIG. 5 is a perspective view illustrating a relationship between the outer cover and the gear portion seen from a rear surface side of the ADF.
Figure 6:
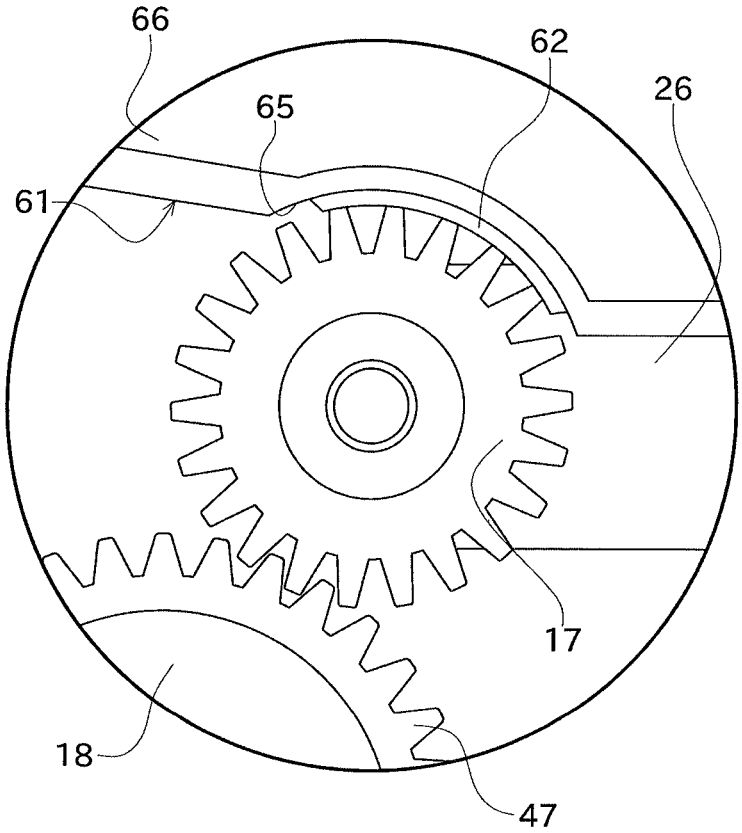
FIG. 6 is an enlarged front view schematically illustrating a state in which a contacting portion of the outer cover is in contact with the gear portion.
Figure 7:
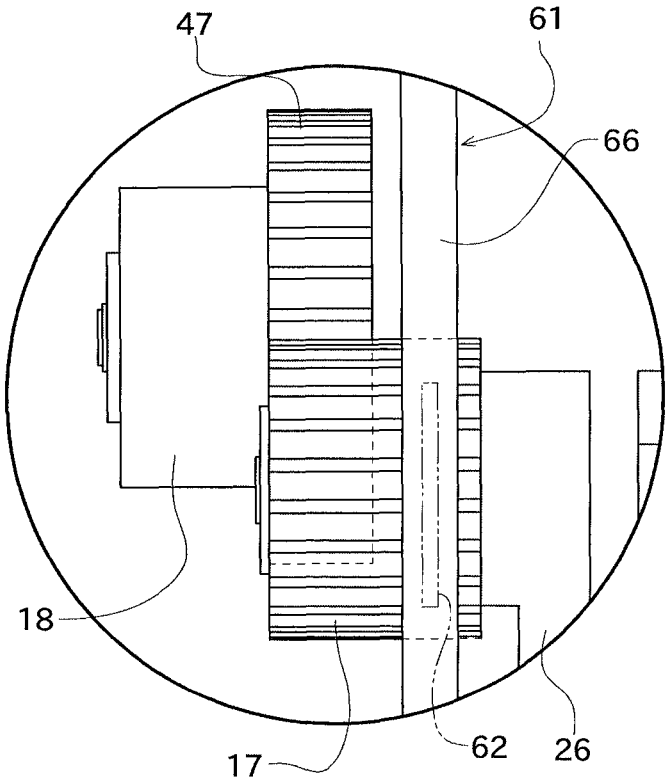
FIG. 7 is an enlarged plan view schematically illustrating a positional relationship of a resistance gear, the gear portion, and the contacting portion.
Figure 8:
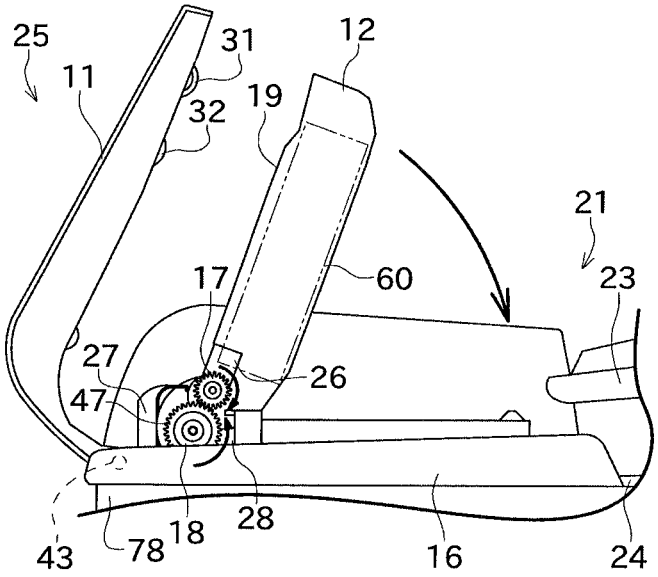
FIG. 8 is a front cross-sectional view schematically illustrating a state in which a scanner frame rotates from an exposed position to a usage position.

The rotation mechanism used in opening and closing the scanner frame 12 arranged in the ADF 25 of the present preferred embodiment will now be described. FIG. 3 is a perspective view illustrating a state of the front surface side of the ADF 25 with the outer cover 61 detached. FIG. 4 is a perspective view illustrating a relationship between the outer cover 61 and a gear portion 17 when seen from the front surface side of the ADF 25. FIG. 5 is a perspective view illustrating a relationship between the outer cover 61 and the gear portion 17 when seen from the rear surface side of the ADF 25. FIG. 6 is an enlarged front view schematically illustrating a state in which a contacting portion 62 of the outer cover 61 is in contact with the gear portion 17. FIG. 7 is an enlarged plan view schematically illustrating a positional relationship between a resistance gear 47, the gear portion 17, and the contacting portion 62. FIG. 8 is a front cross-sectional view illustrating a state in which the scanner frame 12 rotates from an exposed position to a usage position.

The rotation mechanism of the present preferred embodiment rotates the scanner frame 12 between the usage position (see FIG. 2) on the lower side for scanning the document and the exposed position (see FIG. 8) arranged to expose the scanning glass of the ADF side scanner unit 60. The rotation mechanism preferably includes a resistance gear 47, a gear portion 17, a torque limiter 18, a rotation shaft 41, and the outer cover 61.

The resistance gear 47 is arranged to be rotatably supported at the front surface side of an attachment plate 28 arranged on the front surface side of the ADF main body portion 16. The torque limiter 18 is connected to the resistance gear 47 by way of a one-way clutch (not illustrated).

As illustrated in FIG. 3, the gear portion 17 is arranged to be supported at the scanner frame 12 by way of an arm-shaped holding portion 26. More specifically, the holding portion 26 is projected in the direction of the front surface of the device from the scanner frame 12, and then bent to one side (left side in FIG. 2) so as to have a substantially L-shape in plan view of the usage position. The gear portion 17 preferably has a wheel shape, and is projected toward the front surface side from the end of the holding portion 26 such that the axis direction thereof faces the front surface side. The scanner frame 12, the holding portion 26, and the gear portion 17 are integrally provided, so that the scanner frame 12 integrally rotates with the gear portion 17. The teeth of the gear portion 17 merely need to be arrayed in a range that can cover the rotation range of the scanner frame 12, and the configuration thereof can be appropriately changed.

As illustrated in FIG. 3, the gear portion 17 is projected to the front surface side of the scanner frame 12 and is positioned on the front surface side than the guide surface 19 defined on the upper surface of the scanner frame 12. Therefore, a situation where the gear portion 17 obstructs the transportation of the document is reliably prevented by arranging the gear portion 17 on the outer side of the document width direction of the guide surface 19 so as not to overlap the guide surface 19 in plan view. The document width direction as referred to herein is a direction that is perpendicular or substantially perpendicular to the direction of transporting the document in the same plane as the guide surface 19.

The torque limiter 18 applies resistance to the gear portion 17 when the scanner frame 12 rotates from the exposed position to the usage position (see FIG. 8). The torque limiter 18 is arranged to apply a braking force to the rotation of the resistance gear 47, so that the resistance is applied from the resistance gear 47 to the rotation of the gear portion 17. The torque limiter 18 of the present preferred embodiment applies the resistance force to the resistance gear 47 when the scanner frame 12 downwardly rotates by the one-way clutch.

The rotation shaft 41 is arranged on the rear surface side of the scanner frame 12 so that the shaft line thereof coincides with the axis line of the gear portion 17. The rotation shaft 41 is configured to be able to integrally rotate with the scanner frame 12, and is rotatably supported at the ADF main body portion 16.

The outer cover 61 is configured to cover the members arranged on the front surface side of the device such as the resistance gear 47, the torque limiter 18, and the gear portion 17. As illustrated in FIG. 1, the outer cover 61 is configured such that at least one portion of the surface is exposed to the outside.

As illustrated in FIGS. 4 and 5, the outer cover 61 of the present preferred embodiment includes the contacting portion 62 that is arranged to come in contact with the gear portion 17 to position the gear portion 17. The contacting portion 62 of the present preferred embodiment preferably is integrally provided with the outer cover 61.

The contacting portion 62 of the outer cover 61 will now be described. As illustrated in FIG. 5, an arc-shaped recess 65 is provided at the lower end of a rear surface side wall portion 66 of the outer cover 61. The contacting portion 62 is defined as a rib-shape arranged to project to the lower side from an end surface of the recess 65.

As illustrated in FIG. 6, the contacting portion 62 is defined by an arc-shape in front view. The arc portion of the contacting portion 62 has the radius, the position, and the like set to correspond to the shape of a virtual circle defined by connecting the tooth tips of the gear portion 17. The arcuate surface defined at the lower surface of the contacting portion 62 thus can simultaneously come in contact with the plurality of tooth tips positioned on the upper side of the gear portion 17. Accordingly, the gear portion 17 can be positioned at a plurality of areas as the contacting portion 62 comes in contact with the plurality of tooth tips.

Furthermore, as illustrated in FIG. 6, the arc portion of the contacting portion 62 is configured to tilt to the right side so as to face the resistance gear 47 with the gear portion 47 in between. The gear portion 17 is thus pushed in toward the resistance gear 47 side by the contacting portion 61 when the outer cover 61 is attached, whereby an appropriate state is realized for the inter-axis distance of the gear portion 17 and the resistance gear 47. The braking force transmitted through the torque limiter 18 can thus be efficiently transmitted from the resistance gear 47 to the gear portion 17.

As illustrated in FIG. 7, the contacting portion 62 has a thickness in the short direction that is smaller than a thickness of the rear surface side wall portion 66, and the longitudinal direction elongatedly extending in a direction that is perpendicular or substantially perpendicular to the axis direction of the gear portion 17 in plan view. As the longitudinal direction of the contacting portion 62 extends along the rotation direction of the gear portion 17, the wear of the gear portion 17 caused by coming in contact with the contacting portion 62 becomes local.

Moreover, as illustrated in FIG. 7, the contacting portion 62 is positioned on the rear surface side than the resistance gear 47 when the outer cover 61 is attached, and does not overlap the resistance gear 47 when seen in plan view. With the contacting portion 62 arranged in this manner, the gear portion 17 can be separated to a region that is used for positioning (region that wears by coming in contact with the contacting portion 62) and a region that meshes with the resistance gear 47. Thus, even when the gear portion 17 rotates in a state where the contacting portion 62 of the outer cover 61 is in contact with the gear portion 17 and the gear portion 17 wears by such rotation, only the portion that is not meshed with the resistance gear 47 will wear. Therefore, even if the tooth tip of the gear portion 17 chips by the wear, a situation where such a chipped portion adversely affects the meshing of the gear portion 17 and the resistance gear 47 can be reliably prevented.

The attachment task of the scanner frame 12 to the ADF main body portion 16 is preferably carried out in the following manner. First, the rotation shaft 41 is supported at the ADF main body portion 16 without the outer cover 61 attached to the ADF main body portion 16. Then, the gear portion 17 and the resistance gear 47 are meshed. The outer cover 61 is attached when the gear portion 17 and the resistance gear 47 are meshed (state illustrated in FIG. 3). The scanner frame 12 thereby has the front surface side supported at the ADF main body portion 16 through the gear portion 17, the resistance gear 47, and the outer cover 61, and the rear surface side supported at the ADF main body portion 16 through the rotation shaft 41. The scanner frame 12 is bilaterally supported at the ADF main body portion 16 with the axis line of the gear portion 17 as the center of rotation by the gear portion 17, the resistance gear 47, the outer cover 61, and the rotation shaft 41.

The resist roller 39 of the present preferred embodiment overlaps the gear portion 17 in front view (when seen in the axis line direction of the resist roller 39), and is attached to the scanner frame 12 so that the center of rotation of the gear portion 17 and the center of rotation of the resist roller 39 are positioned on the same line. In such a configuration, once the position of the gear portion 17 is determined, the position of the resist roller 39 having the same center of rotation will be determined at the same time. Using such an aspect, the ADF 25 of the present preferred embodiment is configured such that the positioning of the gear portion 17 also serves to position the resist roller 39. The resist roller 39 which center of rotation coincides can be accurately positioned by positioning the position of the gear portion 17 with the outer cover 61. Thus, the outer cover 61 of the present preferred embodiment also functions as a positioning member of the resist roller 39. Furthermore, in such a configuration, the position of the resist roller 39 barely changes during the rotation and before and after the rotation even if the scanner frame 12 is rotated from the usage position to the exposed position. Therefore, the resist roller 39 protruding out to the upper side from the guide surface 19 does not interfere with the document transportation path 30.

When performing maintenance and the like of the ADF side scanner unit 60 with such a configuration, the open/close cover 11 of the ADF 25 is first rotated in the upward direction as if lifting up so that the open/close cover 11 is in the opened state. As a result, the half on the upstream side of the document transportation path 30 is opened. The scanner frame 12 is then lifted up to be rotated to the upper side from the position of FIG. 2 (usage position, closed position), and moved to the position illustrated in FIG. 8 (exposed position, opened position).

When the scanner frame 12 is rotated in the upward direction, the scanner frame 12 attempts to rotate the resistance gear 47 in the clockwise direction through the gear portion 17. When the resistance gear 47 is rotated in the clockwise direction, the resistance force provided by the torque limiter 18 is not transmitted to the resistance gear 47 since the one-way clutch is configured such that it will not to engage with the torque limiter 18. Therefore, the resistance force is barely generated with respect to the gear portion 17, and the rotation from the usage position to the exposed position can be smoothly carried out.

In order to return to the usage position illustrated in FIG. 2 after the maintenance task is finished, the user pushes down the scanner frame 12 by hand. The scanner frame 12 supported at the ADF main body portion 16 rotates in the downward direction.

As illustrated with an arrow in FIG. 8, when the scanner frame 12 is rotated in the downward direction, the scanner frame 12 attempts to rotate the resistance gear 47 in the counterclockwise direction of FIG. 8 through the gear portion 17. However, when the resistance gear 47 is rotated in the counterclockwise direction, the one-way clutch engages with the torque limiter 18, thereby generating a resistance in the direction against the rotation of the resistance gear 47.

As a result, the resistance force by the torque limiter 18 is transmitted to the scanner frame 12 through the resistance gear 47, the gear portion 17, and the holding portion 26, thereby slowing the dropping speed of the scanner frame 12. The force of rotation of the scanner frame 12 thus can be appropriately weakened by the resistance force of the torque limiter 18, and hence the impact at the time of dropping can be alleviated.

In particular, when the scanner frame 12 includes a scanning portion of the reduction optical system as in the present preferred embodiment, the weight of the scanner frame 12 becomes heavy, and a sufficient resistance needs to be applied on the scanner frame 12 to alleviate the dropping speed of the scanner frame 12. In this regard, the ADF 25 of the present preferred embodiment can continuously apply the resistance on the scanner frame 12 over the entire region of the rotation stroke since the gear portion 17 is configured to have a wheel shape that constantly meshes with the resistance gear 47. For example, even when the scanner frame 12 drops from the exposed position to the usage position with gained force, the impact at the time of dropping can be effectively alleviated by the resistance force continuously acting on the scanner frame 12. The open/close cover 11 is thereafter closed so that the ADF 25 is again in a usable state.

The gear portion 17 sometimes tends to move in the direction of riding over the resistance gear 47 when the scanner frame 12 rotates. For example, the gear portion 17 is sometimes pushed up to the immediately upper side of the resistance gear 47 by the resistance gear 47 applied with the resistance of the torque limiter 18. In such a case as well, the movement of the gear portion 17 in the direction of riding over the resistance gear 47 is regulated by the contacting portion 62, and thus the floating of the gear portion 17 (state of riding over the resistance gear 47), and the like do not occur. Furthermore, if the ADF 25 vibrates for some reason, and the gear portion 17 attempts to move in the direction of moving away from the resistance gear 47 by the vibration, such movement will also be regulated by the contacting portion 62. In particular, the contacting portion 62 of the present preferred embodiment can effectively regulate the movement of the gear portion 17 to separate from the resistance gear 47 as the contacting portion 62 is provided in an arc-shape facing the resistance gear 47.

As described above, the contacting portion 62 preferably has a thickness that is smaller than the thickness of the rear surface side wall portion 66 and preferably has an elongated rib-shape in the rotating direction. Therefore, the slide-movement resistance generated by the contact of the gear portion 17 and the contacting portion 62 is very small when the scanner frame 12 rotates. This allows the scanner frame 12 to smoothly rotate while preventing the gear portion 17 from floating.

As described above, the ADF 25 arranged in the image scanner device 10 of the present preferred embodiment is configured as below. In other words, the ADF 25 includes the ADF main body portion 16, the scanner frame 12, the gear portion 17, the resistance gear 47, the torque limiter 18, and the outer cover 61. The scanner frame 12 is supported at the ADF main body portion 16 to be rotatable from the usage position to the exposed position on the upper side to open one portion of the document transportation path 30. The gear portion 17 preferably has a wheel shape, and is arranged on the rotation axis line of the scanner frame 12 to integrally rotate together with the scanner frame 12. The resistance gear 47 is arranged to mesh with the gear portion 17. The torque limiter 18 applies resistance to the resistance gear 47 when the scanner frame 12 rotates from the exposed position to the usage position on the lower side. The outer cover 61 is attached to the ADF main body portion 16 to cover at least one portion of the gear portion 17. The outer cover 61 includes the contacting portion 62 arranged to regulate the movement of the gear portion 17 in the direction of moving away from the resistance gear 47.

Therefore, even if the gear portion 17 attempts to move in the direction of moving away from the resistance gear 47 by the reactive force of the resistance gear 47 applied with resistance by the torque limiter 18 at the time of the rotation of the scanner frame 12, such movement can be regulated by the outer cover 61. Thus, the meshing of the gear portion 17 and the resistance gear 47 at the time of the rotation of the scanner frame 12 thus can be maintained in a satisfactory state. Therefore, the resistance by the torque limiter 18 can be efficiently transmitted to the scanner frame 12 through the resistance gear 47 and the gear portion 17, and the impact caused when the scanner frame 12 drops can be effectively alleviated. Accordingly, as the outer cover 61 positions the gear portion 17, the component for regulating the movement such as the floating of the gear portion 17 can be omitted from the configuration of the ADF 25, thereby achieving reduction in the number of components and enhancement in the efficiency of the assembly task.

The ADF 25 of the present preferred embodiment has the contacting portion 62 of the outer cover 61 provided in an arc-shape according to the shape of the gear portion 17.

Thus, the contacting portion 62 can simultaneously come in contact with a plurality of tooth tips of the gear portion 17. Therefore, a large contacting area where the contacting portion 62 comes into contact with the gear portion 17 is ensured in the circumferential direction of the gear portion 17, and the positioning of the gear portion 17 can be stably and reliably carried out. The movement of the gear portion 17 can be regulated in a wide range by the contacting portion 62 provided in an arc-shape.

The ADF 25 of the present preferred embodiment preferably has the contacting portion 62 of the outer cover 61 elongated in the rotation direction of the gear portion 17.

Thus, the slide-movement resistance between the contacting portion 62 and the gear portion 17 generated at the time of the rotation of the scanner frame 12 can be reduced. Therefore, the movement of the gear portion 17 can be regulated by the outer cover 61 while smoothly rotating the scanner frame 12.

An ADF 25 according to a preferred embodiment of the present invention is configured as described below. The contacting portion 62 of the outer cover 61 is configured to come in contact with the gear portion 17 at a position different in the axis direction of the gear portion 17 from the portion where the gear portion 17 meshes with the resistance gear 47.

Thus, the contacting portion 62 comes in contact with the gear portion 17 at the portion not meshing with the resistance gear 47. Therefore, even if the teeth of the gear portion 17 wear due to the contact with the contacting portion 62, the meshing of the gear portion 17 and the resistance gear 47 can be maintained in an appropriate state as the worn portion is the portion not meshing with the resistance gear 47. Thus, the scanner frame 12 can be smoothly rotated without being influenced by the wear of the gear portion 17.

The ADF 25 of the present preferred embodiment preferably has the gear portion 17 integrally provided with the scanner frame 12.

Thus, the component arranged to attach the gear portion 17 to the scanner frame 12 can be omitted, and the number of components can be further reduced.

The ADF 25 of the present preferred embodiment preferably has the gear portion 17 arranged on the outer side in the document width direction of the document transportation path 30.

Thus, a situation where the gear portion 17 obstructs the transportation of the document is reliably prevented. Jammed documents can also be effectively prevented from being caught at the gear portion 17 during a maintenance task.

The ADF 25 of the present preferred embodiment preferably has the scanner frame 12 include the resist roller 39 arranged so that the axis line coincides with the center of rotation of the gear portion 17.

The position of the resist roller 39 thus does not change at the time of the rotation of the scanner frame 12, and hence a situation where the resist roller 39 comes in contact with another member and breaks due to the rotation of the scanner frame 12 can be reliably prevented. The resist roller 39 is positioned along with the gear portion 17 when the gear portion 17 is fixed by the outer cover 61. Therefore, the component arranged to position the resist roller 39 can be omitted, and hence the number of components can be further reduced.

Preferred embodiments of the present invention have been described above, but the above-described configuration may be further modified as below.

The configuration of the contacting portion 62 of the outer cover 61 in the above-described preferred embodiments may be appropriately changed according to the situation. For example, only one contacting portion 62 of the present preferred embodiment is preferably provided on the outer cover 61, but the number of contacting portion may be increased if so desired. The contacting portion 62 is not limited to a configuration of being provided in an arc-shape, and may also be configured to a linear shape.

In the above-described preferred embodiments, the brake portion is preferably configured by the torque limiter 18, but may be appropriately changed as long as it has a configuration of applying resistance to the rotation of the gear portion 17. The locations and arrangement of the resistance gear 47 and the torque limiter 18 are not limited to the diagonally lower side of the gear portion 17, and may be arranged at appropriate places such as upper side of the gear portion 17, immediately below the gear portion 17, or in the left and right direction. The position of the gear portion 17 supported at the scanner frame 12 by way of the holding portion 26 is also not limited to the configuration of the present preferred embodiments and may be appropriately changed according to the situation.

In the above-described preferred embodiments, the resist roller 39 arranged to correct the obliqueness of the document is preferably configured such that the axis line coincides with the center of rotation of the scanner frame 12, but such a configuration may be appropriately changed according to the situation. For example, it may be configured such that the axis line of the transportation roller that does not have the function of correcting the obliqueness of the document coincides with the center of rotation of the scanner frame 12. A configuration in which the transportation roller including the resist roller 39 is not arranged at the center of rotation of the scanner frame 12 may also be adopted.

A contact image sensor may be used in place of the scanner unit of the reduction optical system as a configuration of the scanning portion held at the scanner frame 12.

In place of the multifunction peripheral 20 of the preferred embodiments, the ADF 25 of the present invention can be applied to a copy machine, a facsimile device, an image scanner device of a single body, and the like.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An automatic document transportation device comprising:

a main body portion;

a rotation frame arranged to be supported at the main body portion to be rotatable from a usage position to an exposed position on an upper side to open one portion of a document transportation path;

a gear portion having a wheel shape and arranged on a rotation axis line of the rotation frame to integrally rotate with the rotation frame;

a resistance gear arranged to mesh with the gear portion;

a brake portion arranged to apply a resistance to the resistance gear when the rotation frame rotates from the exposed position to the usage position on a lower side; and an outer cover attached to the main body portion to cover at least one portion of the gear portion; wherein the outer cover includes a contacting portion arranged to regulate movement of the gear portion in a direction of movement away from the resistance gear; and the rotation frame includes a transportation roller arranged so that an axis line coincides with a center of rotation of the gear portion.

2. The automatic document transportation device according to claim 1, wherein the contacting portion of the outer cover has an arc shape corresponding to a shape of the gear portion.

3. The automatic document transportation device according to claim 2, wherein the contacting portion of the outer cover includes an elongated portion extending in a rotating direction of the gear portion.

4. The automatic document transportation device according to claim 3, wherein the contacting portion of the outer cover is configured to come in contact with the gear portion at a position that is different in an axial direction of the gear portion from a portion where the gear portion meshes with the resistance gear.

5. The automatic document transportation device according to claim 4, wherein the gear portion is integral with the rotation frame.

6. The automatic document transportation device according to claim 5, wherein the gear portion is arranged on an outer side in a document width direction of the document transportation path.

7. A document scanning device including the automatic document transportation device according to claim 1.

* * * * *